US005585694A

United States Patent [19]

Goldburt et al.

[11] Patent Number: 5,585,694

[45] **Date of Patent: *Dec. 17, 1996**

[54] LOW PRESSURE DISCHARGE LAMP HAVING SINTERED "COLD CATHODE" DISCHARGE ELECTRODES

[75] Inventors: Efim Goldburt, Maryknoll, N.Y.; David R. Woodward, Norwalk, Conn.

[73] Assignee: North American Philips Corporation, New York, N.Y.

[ * ] Notice: The term of this patent shall not extend beyond the expiration date of Pat. No. 5,138,224.

[21] Appl. No.: 927,587

[22] Filed: Aug. 10, 1992

Related U.S. Application Data

[63] Continuation-in-part of Ser. No. 624,387, Dec. 4, 1990, Pat. No. 5,138,224.

[51] Int. Cl.[6] ..... H01J 61/067; H01J 61/42

[52] U.S. Cl. ..... 313/491; 313/346 R; 313/630; 313/631; 313/633

[58] Field of Search ..... 313/491, 630, 313/346 DC, 346 R, 631, 633, 311

[56] References Cited

U.S. PATENT DOCUMENTS

| | | | |
|---|---|---|---|
| 2,389,060 | 11/1945 | Kurtz | 313/346 DC |
| 2,677,623 | 5/1954 | Delrieu et al. . | |
| 2,753,615 | 7/1956 | Claude et al. . | |
| 3,325,281 | 6/1967 | Ebhardt . | |
| 3,563,797 | 2/1971 | Young et al. | 313/491 |
| 3,718,831 | 2/1973 | Butter et al. . | |
| 3,758,809 | 9/1973 | Menelly et al. . | |
| 4,303,848 | 12/1981 | Shimizu et al. | 313/311 |
| 4,808,883 | 2/1989 | Iwaya et al. . | |
| 5,138,224 | 8/1992 | Goldburt et al. | 313/491 |

FOREIGN PATENT DOCUMENTS

| | | |
|---|---|---|
| 0253316 | 7/1987 | European Pat. Off. . |
| 0262699 | 8/1987 | European Pat. Off. . |
| 0378338 | 1/1990 | European Pat. Off. . |
| 0489463 | 6/1992 | European Pat. Off. . |
| 54-51944 | 4/1979 | Japan . |
| 1-63254 | 3/1989 | Japan . |
| 1-77857 | 3/1989 | Japan . |
| 1-63253 | 3/1989 | Japan . |
| 2236941 | 9/1990 | Japan . |
| 0364845 | 3/1991 | Japan . |

*Primary Examiner*—John K. Peng
*Assistant Examiner*—Andrew Hill
*Attorney, Agent, or Firm*—Brian J. Wieghaus

[57] ABSTRACT

A fluorescent low pressure discharge lamp is provided with axially mounted cold-cathode electrodes consisting of a sintered shaped mixture of inorganic material including about 50–90% by weight of tungsten and the remainder BaO or a mixture of BaO, CaO and SrO and oxides of Y, Zr or Hf or the rare earths. The electrodes have a uniform density throughout with a porosity of less than 10%.

20 Claims, 2 Drawing Sheets

LOW PRESSURE DISCHARGE LAMP HAVING SINTERED "COLD CATHODE" DISCHARGE ELECTRODES

CROSS-REFERENCE TO RELATED APPLICATIONS

This is a continuation-in-part of U.S. application Ser. No. 624,387 filed Dec. 4, 1990, U.S. Pat. No. 5,138,224, entitled "Fluorescent Low Pressure Discharge Lamp" of Efim S. Goldburt and Willem M. Hellebrekers which discloses and claims a fluorescent lamp having sintered transversely-mounted hot cathode bar electrodes connected to respective pairs of lead-in wires.

BACKGROUND OF THE INVENTION

This invention relates to low pressure discharge lamps having "cold-cathode" type discharge electrodes and, more particularly, to a fluorescent low pressure mercury vapor discharge lamp of the "instant-start" type having a pair of cold-cathode discharge electrodes.

There are two types of cathodes predominantly used in the fluorescent lamp arts. They are both heated to their "thermionic emission temperature", the temperature at which they emit electrons, during lamp operation to provide a source of electrons to support the discharge arc. One of said cathode types is termed a "hot cathode" and is heated to its emission temperature by u heated filament and the arc discharge whereas the other type of cathode is a "cold cathode" and is heated to its emission temperature solely by the arc discharge.

The hot cathode type electrodes most commercially prevalent in the art consist of a tungsten filament coated with a suitable emitter material, for example a mixture of the oxides of barium, strontium and calcium, which readily releases electrons when heated to a temperature of about 800° C.

Hot cathode electrodes are used in both "pre-heat" and "rapid-start" lamps. In preheat lamps, the electrodes are heated to their emission temperature prior to ignition of the lamp by a pre-heat current. The ample supply of electrons emitted from the hot cathodes enable the lamp to ignite at voltages of about 100–300 V. The heater current is switched off after a discharge arc is ignited between the electrodes and the high temperature necessary for free emission of electrons is maintained after ignition by ionic bombardment from the discharge. In rapid start lamps, the heater current is not turned off and continues to flow through the filament electrodes after the lamp is burning.

Cold-cathode electrodes are used in "instant-start" lamps and do not employ a heater current to generate electrons to aid in lamp starting. Instant-start lamps rely solely on a high voltage of about 400 to 1000 volts between the two electrodes to initiate a glow discharge. The glow discharge provides further heating of the electrodes causing an almost instantaneous transition to an arc discharge.

The cold cathodes predominantly used in "instant start" lamps employ a helically wound tungsten filament coated with emissive material, as with hot cathode electrodes, but are of much sturdier construction and contain significantly more emitter material. Instead of a tungsten filament, other cold cathodes known in the art employ a metallic can or holder in which a substantial quantity of emitter material is deposited, as known for example from U.S. Pat. Nos. 2,677,623 (Claude et al); 3,325,281 (Ebhardt); and 2,753,615 (Claude et al).

Fluorescent lamps having filament type hot cathodes have a life which is typically limited to about 10,000 to 20,000 hours, depending on lamp wattage, due to the fact that only a limited quantity of the emissive material can be coated on the filaments and due to evaporation and scattering of the emitter material off of the filament due to ionic bombardment from the discharge. Instant-start cold-cathode lamps, by contrast, have approximately half the life of a hot-cathode lamp of corresponding wattage because the ionic bombardment of the glow-to-arc discharge transition upon starting of these lamps causes significantly more sputtering of the emitter material from the electrode.

A problem with filament type electrodes, whether for hot or cold cathode use, is that it is difficult to provide an adequate control of the amount of emissive material provided on the coiled tungsten wire. The filament electrodes are dipped in a liquid mixture including, for example barium carbonate, strontium carbonate, and calcium carbonate along with butyl acetate, nitrocellulose, butanol and zirconium oxide. After sealing in the lamps, the dipped filaments are treated according to a treatment schedule which includes passing various levels of electric current through the filaments to heat the filaments and convert the carbonates to oxides. During this treatment, the lamps are also evacuated to remove any volatiles driven off from the emitter material. The accumulation of small variations in the length and weight of the filaments, in the liquid mixture and the amount coated on the filament, and in the treatment schedule on the assembly line contribute to undesirable variations in the actual quantity of emissive material provided on the electrode in the finished lamp. Since lamp life is very sensitive to the quantity of emissive material provided, it is very difficult to control the life distribution of the lamps so as to manufacture lamps having a very narrow life distribution.

Various fused pellet composite discharge electrodes have been proposed for both hot and cold cathode operation for fluorescent lamps. U.S. Pat. No. 3,766,423 (Menelly) shows a hot cathode electrode formed with a thermochemical sintering method by mixing tungsten with oxides of barium or with mixtures of oxides of barium, calcium and strontium. The mixture is pressed about metal leads and then heated until an exothermic reaction occurs. No yttrium oxide is present. The electrode produced has a density gradient containing 80% voids in the surface of the electrode extending down to 10% voids in the central portion of the electrode. It has been found, however, that such electrodes are very fragile and are difficult to degas because of the high porosity. U.S. Pat. No. 3,758,809 (Menelly) discloses a similarly formed composite "cold-cathode" electrode which includes an integral metal lead extending from the bottom surface thereof. The pellet has a bulk density gradient structure wherein the interior portions and exterior bottom and side portions have a higher bulk density relative to the top portion of the pellet. Furthermore, the top portion of the pellet has a rough surface as compared to the smooth surface of the exterior bottom and side surfaces.

Butter et al, U.S. Pat. No. 3,718,831 discloses yet another thermochemically sintered composite electrode having a bulk density gradient structure with an integral lead. Butter discloses that the cold cathodes of Menelly '809 were unsatisfactory because their ignition voltage was found to increase rapidly after a short burning time such that they could not be ignited on standard commercial ballasts. This was believed to be due to excessive sputtering and migration of the emitter material from the surface into the interior regions of the electrode. The electrode according to Butter has a cavity of conic section which reduces the amount of emitter material dislodged from the surface of the electrode and creates an electric field which causes migration of the emitter material to the outside surface of the electrode, where the discharge terminates on this electrode. A disadvantage, however, of the Butter electrode is its complicated shape.

Iwaya et al, U.S. Pat. No. 4,808,883 shows a discharge lamp containing a "cold-cathode" electrode formed of a semiconductor ceramic material. The electrode in this lamp contains tungsten only in an amount up to 0.8 mol % and does not contain rare earth emitter materials. Other cathode configurations using semiconductor ceramics without rare earth emitter materials are known from JP 1-63253, JP 1-63254 and JP 1-77857.

Composite electrodes are also known for high pressure discharge lamps. U.S. Pat. No. 4,303,848 (Shimizu et al) discloses a sintered electrode formed from a mixture of a high melting point metal, an emissive material of an alkaline earth metal or compound thereof, and at least one oxide of a metal selected from the group consisting of yttrium, zirconium, and aluminum. An electrode supporting rod is integrally sintered in the electrode. The electrode is formed by first mixing a base metal powder with an organic binder to form agglomerates, which are then granulated. An electron emissive powder is similarly prepared, mixed with the granulated base metal powder, and the mixture compacted at a pressure of 3 ton/cm$^2$. Before sintering at 1400°'–1600° C. the compacted mixture is heated at a lower temperature for an extended period to drive off the organic binder. Because of the use of an organic binder which is later driven off, the disclosed compaction pressures and sintering temperatures, and the particle sizes of 60–180 μm the Shimizu electrode would have a porosity significantly greater than 10%.

SUMMARY OF THE INVENTION

It is an object of this invention to provide an improved low pressure discharge lamp having cold-cathode discharge electrodes.

It is another object of this invention to provide an improved instant-start fluorescent low pressure discharge lamp having an improved sintered electrode.

According to the invention, it has been found that cold-cathode low pressure discharge lamps, particularly instant-start fluorescent low pressure discharge lamps, of highly improved characteristics may be manufactured by employing as the electrode, a sintered shaped mixture of inorganic material including an electron emissive metal oxide, greater than 50% by weight of a refractory metal, and having a uniform density throughout with a porosity of less than 10%, the electrode extending axially within the lamp envelope and being connected to a respective current conductor of the lamp.

The low porosity and uniform density yield an electrode which does not need to be degassed during lamp fabrication, substantially does not outgas during lamp operation, and has favorable ignition characteristics for starting on commercial lamp ballasts.

According to favorable embodiment, the electrode consists of about 50% to 90% by weight of tungsten, 5 to 25% by weight of barium oxide or approximately a 1:1:1 by weight mixture of barium oxide, calcium oxide and strontium oxide and 5–25% by weight of electron emissive metal oxide selected from the group consisting of the oxides of yttrium, zirconium, hafnium and of the rare earths. Instead of tungsten, other suitable refractory metals include molybdenum and tantalum, with the same weight percentages of the barium, calcium, and/or strontium oxides and of the electron emissive metal oxides as employed with the tungsten.

These and other objects of the invention will be apparent from the drawings and detailed description that follows.

DESCRIPTION OF THE PREFERRED EMBODIMENTS

Figure 1:
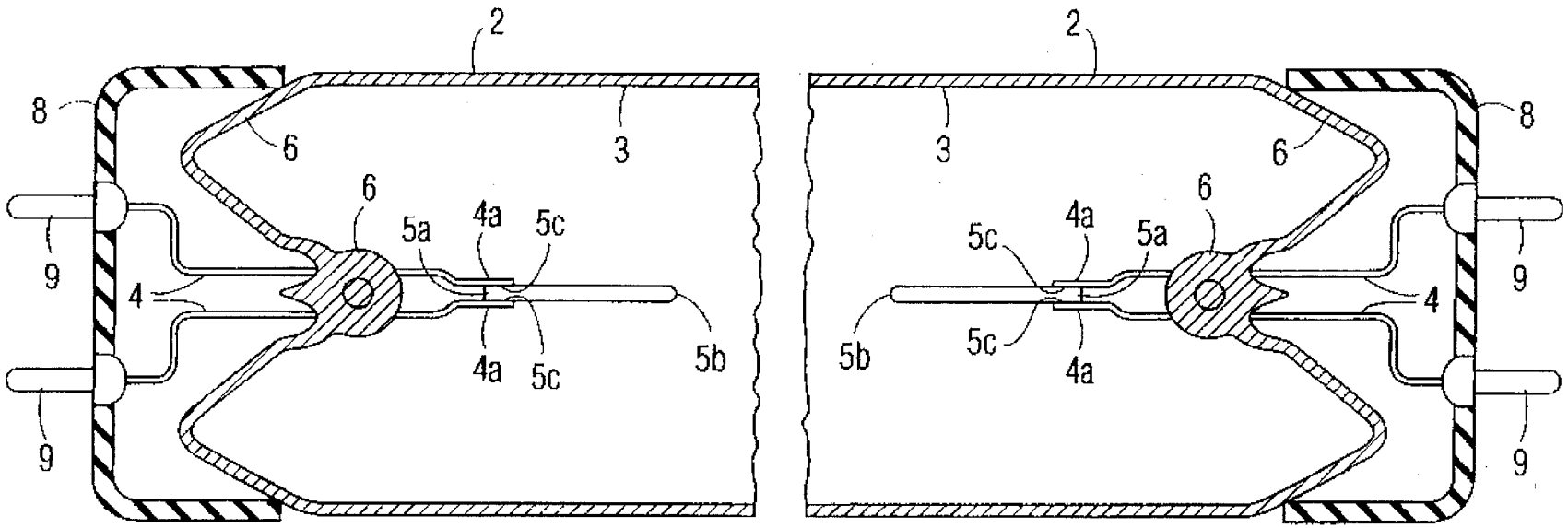
FIG. 1 is a cross-sectional view of a mount construction in an instant-start fluorescent low pressure discharge lamp of the invention employing axially mounted "cold-cathode" sintered discharge electrodes.

The fluorescent low pressure mercury discharge lamp of FIG. 1 has a tubular shaped glass envelope 2 the inside surface of which has a light emitting phosphor layer 3. Sintered cold-cathode discharge electrodes 5 of the composition discussed above are axially mounted adjacent sealed end portions in the form of lamp stem 6 and electrically connected to respective current conductors 4 which extend through the sealed end portions in a gas tight manner. The current conductors consist of a pair of lead-through wires which are connected to respective lamp contact pins 9 on base 8. The lamp has a conventional discharge sustaining filling of a rare gas at a pressure of 1 to 10 torr and a small amount of mercury. During lamp operation a gas discharge is maintained between the electrode 5 and an identically mounted electrode at the opposite end of the lamp.

While any metal oxide of the group consisting of the oxides of yttrium, zirconium, neodymium and hafnium may be employed, it is found that best results are achieved when the metal oxide is $Y_2O_3$. Tungsten is favorable because of its ease of processing and widespread use as an electrode material, although other refractory metals such as molybdenum and tantalum may be used.

Preferably, the sintered electrodes are made from a mixture of 50 to 90% by weight of tungsten, 5 to 25% by weight of yttrium oxide and 5 to 25% by weight of barium oxide, the particle sizes of these ingredients being 0.05–10 um. In a favorable embodiment, the tungsten is further limited to 80% by weight or less, and the percentage by weight of yttrium oxide and barium oxide is 10–25%. The said ranges for barium oxide, yttrium oxide and their particle sizes are equally applicable when the refractory metal is molybdenum and tantalum.

The electrodes are manufactured by pressing and sintering mixtures of powders of tungsten and the oxides, or the tungsten powder is first coated with the oxides by a sol gel technique. This ensures that the sintered electrodes are extremely homogenous. The coated powders are then pressed and sintered. Pressing is generally carried out by isostatic pressing at a pressure of about 8,000–38,000 psi. Sintering is carried out in a reducing atmosphere, preferably in an atmosphere containing up to about 5% of hydrogen in an inert gas such as helium at a temperature of about 1600° C.–2200° C. from 5 minutes to 1 hour.

While the electrodes may have any desired shape they are conveniently rod-shaped with a length of at least 1 mm with a length of up to about 20 mm and preferably up to about 10 or 15 mm. Preferably the thickness of the rod is 0.2–2 mm. Providing a tapered tip at the end of the rod in which the discharge terminates will improve lamp starting.

While the electrodes may be directly pressed and sintered into bars, the electrodes may be first formed as sintered wafers, which wafers are then cut into bars of desired size. By forming large wafers, for example 30 cms in diameter, many electrodes can be cut therefrom, which reduces lamp cost. The electrodes will be extremely uniform with each other because they are cut from the same wafer.

The above described method of manufacture of the electrodes according to the invention is significantly different than that used for the Menelly '423 and '809 and the Butter '831 electrodes and results in an electrode with significantly different characteristics. For example, Menelly compresses the mixture at about 1,000 to 4,000 psi in mold and heats the mixture to only 700 to 1000 degrees to obtain an exothermic reaction. This results in an extremely non-uniform electrode having particle sizes which vary from tenths of microns up to 50 microns and porosities which vary from 10% voids to 80% voids. The Butter electrodes are produced in a similar manner and have a gradient structure with a similar porosity. As previously discussed, the Shimuzu electrode has a porosity much greater than 10%.

By use of the sintered electrodes according to the invention, it is expected that it will be possible to more closely control the life expectancy of the lamp, while reducing its cost, as compared to lamps having conventional filament electrodes in which the emitter material is applied by dipping and as compared to the exothermically formed sintered electrodes. The variations among the exothermically formed electrodes as described in the prior art, and the spread of lamp life of lamps employing these electrodes, would be expected to be large. Each electrode is manufactured in a separate mold to obtain the desired gradient across the electrode and to integrally mold the conductive lead(s) therein. The variations in the fill level and compression pressure in the mold for each electrode, the mold shapes, the temperature variations among the molds, and the inherent variations in the homogeneity of the mixture all will effect the exothermic reaction. Additionally, the need for an individual mold for each electrode significantly increase electrode, and hence, lamp cost.

The sintered electrodes according to the invention are formed by closely controlled chemistry without an exothermic reaction, which provides significantly less variation in the amount of emitter material present in the electrode. The emitter mixture from which the electrodes according to the invention are pressed and sintered includes only oxides. By contrast the mixtures in the prior art included carbonates which are later converted to oxides by heating.

Furthermore, the sintered electrodes according to the invention do not require any kind of treatment schedule in the lamp. Because of the ease of fabrication and the lack of a treatment schedule, it is expected that lamps having such electrodes will be cheaper to manufacture than lamps employing a conventional dipped filament electrode, as well as having a narrower life distribution.

Method of Installation

The electrodes are preferably secured to the lead-through wires by laser welding. Bending of the lead-through wires around the end of the electrodes to clamp the electrode was found to be unsatisfactory with respect to both the electrical and mechanical connection. Conventional contact welding between two welding contacts was also found to be unsatisfactory. The welding current passing through the end of the sintered electrode was found to heat it sufficiently such that its structure was modified. Additionally, with conventional contact welders used to weld filament electrodes to lead wires it was found that it was difficult to control the contact pressure of the welding contacts on the sintered electrode, which resulted in poor welds as well as breakage of the sintered electrodes.

The basal end 5*a* of the electrode opposite the tapered tip 5*b* is held between the flattened end portions 4*a* of the lead-through wire 4. A beam of laser light is directed onto a region of each lead-wire immediately adjacent a lateral edge 5*c* of the sintered electrode to form a pool of molten metal which wets the sintered electrode. The beam of laser light is then removed such that the pool of molten metal solidifies and coalesces with the lead wire and the sintered electrode. This is conveniently accomplished after sealing the lead wires in the lamp stem in a conventional manner, but before sealing of the completed stem to the lamp vessel. Favorably, the electrode is welded along each of the two lateral edge 5*c* proximate the respective flattened portion 4*a*, for a total of four (4) welds.

Good welds were obtained using a Nd:YAG pulsed laser using pulse widths of 10 to 20 msec and energies of 3 to 5 Joules. The diameter of the laser light directed onto the flattened lead was about 200–600 microns. While optimally the laser beam is directed at the lead-through at a location closely proximate the lateral edge of the electrode, it has also been found that the beam may impinge on a portion of the electrode without degrading the quality of the weld or damaging the electrode due to the extremely localized heating of the electrode by the laser beam.

The lead-through wires consisted of nickel-plated steel. Other suitable materials include nickel-plated brass, nickel plated cupro-nickel, tin-plated brass, or tin-plated cupro-nickel.

Extra metallic material, for example a thin wire or foil, may first be welded to the lead wire, followed by laser welding of the lead-wire and to this extra material to the electrode. The extra metal increases the pool of molten metal to improve wetting of the electrode. A thin 9 mil molybdenum wire, about 2–3 mm in length, welded to the flattened end portion by laser welding was found to be satisfactory for this purpose.

Figure 2:
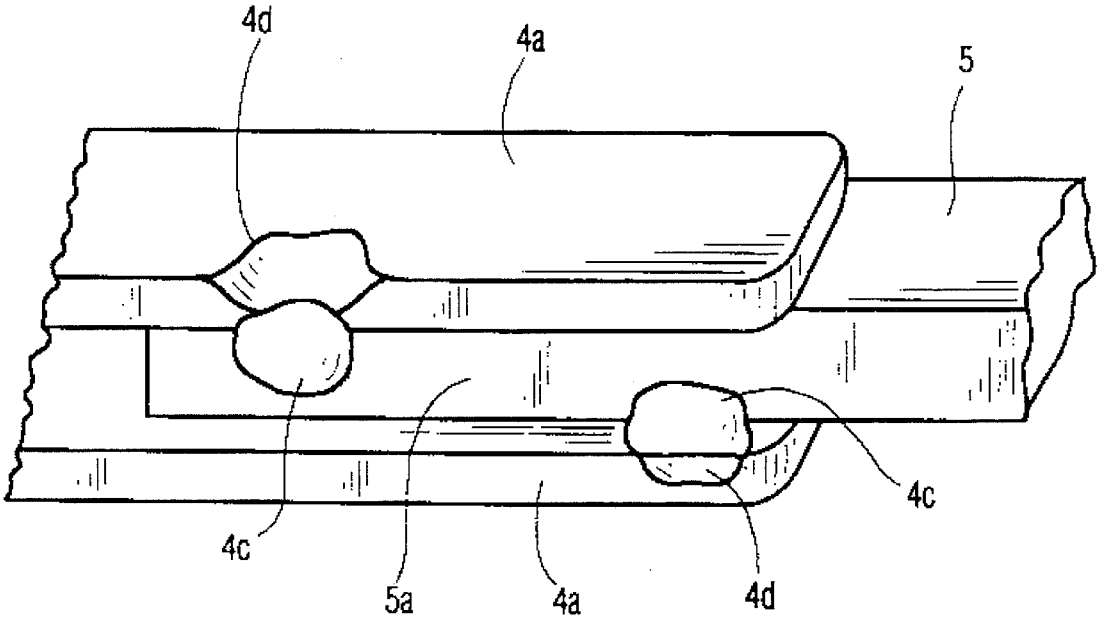
FIG. 2 is a perspective view of the weld connection of the mount of FIG. 1 illustrating the visual appearance of the welds.

FIG. 2 illustrates an exemplary appearance of the welds in the mount construction of FIG. 1. The welds have the appearance of a ball of metal 4*c* which has sides coalesced with both the flattened lead-through wire portion 4*a* and the side of the electrode. The lead-through wire typically has pits, or cavities, 4*d* indicative of metal having been melted and displaced therefrom.

It will be readily apparent that other configurations may be used. For example, the base may include one central contact pin and the electrode mount may include one conductive lead at each end instead of the two conductive leads shown in FIG. 1.

EXAMPLE 80 weight percent of tungsten of a particle size of 0.4 μm was coated with 10 percent by weight of yttrium oxide and 10 percent by weight of barium oxide.

The tungsten powder was coated with the yttrium oxide and the barium oxide employing a sol-gel technique. In carrying out this technique the tungsten powder was dispersed in a mixture of yttrium isopropoxide and barium butoxide in organic solvents in concentrations so as to provide 10 percent by weight of yttrium oxide and 10 percent by weight of barium oxide. The mixture was then formed into a dispersion and the resultant dispersion was heated at a temperature of about 90° C. to remove the solvents. The resultant coated powder was then fired at a temperature of about 620° C. for two hours in a nitrogen atmosphere containing about 2% of hydrogen.

The powder was then formed into pellets (1.4 mm thick and 25 mm in diameter) by pressing at a pressure of about 19000 psi. The pellets were then sintered at 2000° C. for about 1 hour in an atmosphere of 95% helium and 5% hydrogen. The resultant pellets were then cut into bars of dimensions of 0.3×0.3×18 mm The resultant bars had porosities of less than 10% and a resistance of 2–4 ohms.

Four foot T12 fluorescent lamps with the prefabricated bar electrodes were subjected the following test to determine their operability. The lamps were connected to a commercial single lamp instant start ballast (Advance SM140-TP). Power was supplied to the ballast by a variac connected to the main supply voltage. With the variac set at 120 V output to the ballast, the lamp ignited in an arc discharge. The initial arc was to the leads close to the glass seals. The tip of the electrodes had a faint reddish glow initially and this increased in intensity, the electrodes got hotter and then the arc jumped to the tips of both electrodes and gave an arc. The initial arc was sufficient to heat the bar electrodes to temperatures necessary for thermionic emission and the arc jumped to the electrode tips. The glow to arc transition time was comparable to that of a regular instant start lamp with conventional electrodes.

What is claimed is:

1. A low pressure discharge lamp having a tubular lamp envelope defining a discharge path between sealed end portions of said envelope, a discharge sustaining filling within said envelope, and a pair of cold-cathode discharge electrodes arranged axially within said lamp envelope between which a discharge is sustained during lamp operation, wherein the improvement comprises:

each electrode is a sintered shaped mixture of inorganic material including an electron emissive metal oxide, greater than about 50% by weight of a refractory metal, and having a uniform density throughout with a porosity of less than about 10%.

2. A low pressure discharge lamp according to claim 1, wherein each electrode consists of about 50%–90% by weight of W, 5–25% by weight of BaO or of a 1:1:1 by weight mixture of BaO, CaO and SrO and 5–25% by weight of an electron emissive metal oxide selected from the group consisting of the oxides of Y, Zr, Hf and the rare earths.

3. The lamp of claim 2, wherein the metal oxide is $Y_2O_3$.

4. The lamp of claim 2, wherein the electrodes are pressed and sintered mixtures of about 50–80% by weight of W, 10–25% by weight of $Y_2O_3$ and 10–25% by weight of BaO.

5. The lamp of claim 4 wherein the electrodes are formed by pressing the mixture of inorganic material and sintering the pressed mixture in hydrogen in an amount of about 5% at a temperature of 1600° C.–2200° C. for 5 minutes to 1 hour.

6. The lamp of claim 5, wherein the mixture of inorganic material is formed into a presintered body by pressing at a pressure of 8000–38000 psi.

7. The lamp of claim 6, wherein the electrodes are rod-shaped with a length of at least about 1 mm and a thickness of 0.2–2 mm.

8. The lamp of claim 7, wherein the lamp is a low pressure mercury vapor discharge lamp provided with a rare gas at a pressure of 1 to 10 torr and a small amount of mercury.

9. The lamp of claim 1, wherein the mixture of inorganic material is formed into a presintered body by pressing at a pressure of 8000–38000 psi.

10. The lamp of claim 9, wherein the pressed and sintered mixtures are formed of mixtures consisting essentially of about 80% by weight of W, about 10% by weight of BaO and about 10% by weight of $Y_2O_3$.

11. The lamp of claim 10, wherein the electrodes are formed by pressing the mixtures of inorganic material into rod-shaped bodies by pressing at a pressure of 8000–38000 psi and then sintering the resultant presintered bodies in an atmosphere of up to about 5% of hydrogen in helium at a temperature of about 1600° C.–2200° C. for 5 minutes to 1 hour.

12. The lamp of claim 11, wherein the presintered bodies are sintered at a temperature of about 2000° C. for about 1 hour.

13. The lamp of claim 11, wherein in a mixture employed in forming the presintered rod, the particle size of W is 0.05–10 μm, the particle size of BaO is 0.05–10 μm and the particle size of $Y_2O_3$ is 0.05–10 μm.

14. The lamp of claim 11, wherein the tungsten consists of tungsten particles provided with essentially uniform coatings of BaO and $Y_2O_3$.

15. The lamp of claim 10, wherein the tungsten consists of tungsten particles provided with essentially uniform coatings of BaO and $Y_2O_3$.

16. The lamp of claim 10, wherein the presintered bodies are rods of a thickness of about 0.2–2 mm and a length of at least 1 mm.

17. The lamp of claim 1, wherein the inorganic material consists of tungsten particles provided with essentially uniform coatings of BaO or a 1:1:1 mixture of BaO, SrO and CaO and an oxide selected from the group consisting of Y, Zr, Hb and the rare earth.

18. An instant-start low pressure mercury vapor fluorescent lamp, comprising:

a tubular translucent lamp envelope defining a discharge path between respective sealed end portions thereof;

a luminescent material on the inner surface of said envelope;

a discharge sustaining filling comprising mercury and a rare gas within said envelope;

a pair of current conductors each extending into said lamp envelope through a respective sealed end portion; and a pair of cold cathode discharge electrodes each directly connected to a respective current conductor and extending axially within a respective sealed end portion, each discharge electrode being a sintered shaped mixture of inorganic material consisting of about 50%–90% by weight of a refractory metal selected from the group consisting of tungsten, tantalum, and molybdenum, 5–25% by weight of BaO or of a 1:1:1 by weight mixture of BaO, CaO and SrO and 5–25% by weight of a metal oxide selected from the group consisting of the oxides of Y, Zr, Hf and the rare earths, and having a porosity of less than about 10%.

19. A fluorescent lamp according to claim 18, wherein said sealed end portion comprises a lamp stem, and said current conductors are comprised of a pair of lead-through wires.

20. A low pressure discharge lamp having a tubular lamp envelope defining a discharge path between sealed end portions of said envelope, a discharge sustaining filling within said envelope, and a pair of discharge electrodes arranged axially within said lamp envelope between which a discharge is sustained during lamp operation, wherein the improvement comprises:

a said electrode is a sintered shaped mixture of inorganic material including an electron emissive metal oxide, greater than about 50% by weight of a refractory metal, and having a uniform density throughout with a porosity of less than about 10%.

* * * * *